US009435154B2

(12) United States Patent
Chen

(10) Patent No.: US 9,435,154 B2
(45) Date of Patent: Sep. 6, 2016

(54) BLIND BODY POSITIONING MECHANISM FOR NON PULL CORD WINDOW BLIND AND WINDOW BLIND USING THE SAME

(71) Applicant: Chin-Fu Chen, Taichung (TW)

(72) Inventor: Po-Yu Chen, Taichung (TW)

(73) Assignee: Chin-Fu Chen, Taichung (TW)

( * ) Notice: Subject to any disclaimer, the term of this patent is extended or adjusted under 35 U.S.C. 154(b) by 0 days.

(21) Appl. No.: 14/533,607

(22) Filed: Nov. 5, 2014

(65) Prior Publication Data

US 2016/0123073 A1 May 5, 2016

(51) Int. Cl.

| | |
|---|---|
| ***E06B 9/30*** | (2006.01) |
| ***E06B 9/34*** | (2006.01) |
| ***E06B 9/322*** | (2006.01) |
| ***E06B 9/262*** | (2006.01) |

(52) U.S. Cl.

CPC ..... *E06B 9/34* (2013.01); *E06B 9/262* (2013.01); *E06B 9/30* (2013.01); *E06B 9/322* (2013.01); *E06B 2009/3222* (2013.01)

(58) Field of Classification Search

CPC .. E06B 9/26; E06B 9/368; E06B 2009/2625; E06B 2009/2627; E06B 9/30; E06B 9/303; E06B 9/32; E06B 9/322; E06B 2009/3222

USPC ..... 160/170, 84.01, 84.05, 168.1 R, 173 R, 160/166.1

See application file for complete search history.

(56) References Cited

U.S. PATENT DOCUMENTS 4,691,589 A * 9/1987 Arakawa ..... F16F 9/12 464/180
4,697,673 A * 10/1987 Omata ..... E05F 3/14 16/52
4,830,151 A * 5/1989 Numata ..... F16D 41/206 16/82
5,460,252 A * 10/1995 Kosugi ..... E05F 3/14 16/85
5,605,208 A * 2/1997 Friedrichsen ..... F16F 7/04 16/354
6,149,094 A * 11/2000 Martin ..... E06B 9/322 160/168.1 P
6,289,965 B1 * 9/2001 Ruggles ..... E06B 9/60 160/170
6,318,661 B1 * 11/2001 Martin ..... E06B 9/322 242/373
6,571,853 B1 * 6/2003 Ciuca ..... E06B 9/60 160/170
6,601,635 B2 * 8/2003 Ciuca ..... E06B 9/32 160/170
6,644,375 B2 * 11/2003 Palmer ..... E06B 9/90 160/170
6,666,252 B2 * 12/2003 Welfonder ..... E06B 9/42 160/296

(Continued)

FOREIGN PATENT DOCUMENTS

DE 202015102349 * 6/2015

*Primary Examiner* — Katherine Mitchell
*Assistant Examiner* — Johnnie A Shablack
(74) *Attorney, Agent, or Firm* — Muncy, Geissler, Olds & Lowe, P.C.

(57) ABSTRACT

A window body positioning mechanism of a non pull cord window blind includes a transmission unit including two first transmission wheels meshed together, a coil spring connected between the first transmission wheels and wound round one first transmission wheel, two second transmission wheels respectively meshed with one respective first transmission wheel, and two transmission cords each having one end thereof fixedly connected to one respective second transmission wheel and being wound round the respective second transmission wheel upon its rotation, and a damper unit including a damper and a reel connected to the damper and wound round by one transmission cord in such a manner that when the blind body is being extended out or received, the damper imparts a damping resistance to the transmission cords through the reel to achieve excellent positioning effects.

12 Claims, 6 Drawing Sheets

(56) References Cited

U.S. PATENT DOCUMENTS 6,761,203 B1 * 7/2004 Huang ..... E06B 9/322 160/170
6,968,929 B2 * 11/2005 Doornbos ..... F16F 9/12 188/290
7,025,107 B2 * 4/2006 Ciuca ..... E06B 9/322 160/170
7,331,370 B1 * 2/2008 Militello ..... E06B 9/322 160/170
7,360,736 B2 * 4/2008 Zangirolami ..... E06B 9/54 160/296
7,406,995 B2 * 8/2008 Huang ..... E06B 9/322 160/170
8,220,603 B2 * 7/2012 Cultraro ..... F16F 9/145 188/291
8,297,332 B2 * 10/2012 Lin ..... E06B 9/322 160/170
8,863,812 B2 * 10/2014 Lin ..... E06B 9/262 160/170
8,893,763 B2 * 11/2014 Huang ..... E06B 9/322 160/170
8,925,615 B2 * 1/2015 Lin ..... E06B 9/322 160/170
8,936,062 B2 * 1/2015 Huang ..... E06B 9/322 160/170
9,127,500 B2 * 9/2015 Huang ..... E06B 9/322
2002/0088562 A1 * 7/2002 Palmer ..... E06B 9/90 160/170
2003/0024656 A1 * 2/2003 Ciuca ..... E06B 9/322 160/170
2003/0196765 A1 * 10/2003 Ciuca ..... E06B 9/32 160/170
2004/0007333 A1 * 1/2004 Militello ..... E06B 9/262 160/84.04
2004/0177933 A1 * 9/2004 Hillman ..... E06B 9/322 160/170
2006/0096719 A1 * 5/2006 Wu ..... E06B 9/388 160/170
2006/0278348 A1 * 12/2006 Huang ..... E06B 9/322 160/170
2007/0227677 A1 * 10/2007 Yu ..... E06B 9/322 160/170
2008/0099159 A1 * 5/2008 Nien ..... E06B 9/368 160/170
2008/0185109 A1 * 8/2008 Lin ..... E06B 9/262 160/170
2009/0078380 A1 * 3/2009 Cheng ..... E06B 9/42 160/291
2009/0159219 A1 * 6/2009 Wen ..... E06B 9/322 160/170
2009/0321022 A1 * 12/2009 Yu ..... E06B 9/322 160/84.05
2010/0206492 A1 * 8/2010 Shevick ..... E06B 9/30 160/170
2012/0061502 A1 * 3/2012 Chen ..... E06B 9/322 242/372
2013/0032300 A1 * 2/2013 Yu ..... A47H 5/032 160/84.02
2013/0153347 A1 * 6/2013 Oda ..... F16J 15/16 188/290
2014/0083631 A1 * 3/2014 Huang ..... E06B 9/322 160/170
2014/0216663 A1 * 8/2014 Lin ..... E06B 9/262 160/84.01
2014/0224431 A1 * 8/2014 Lin ..... A47H 5/032 160/84.01
2014/0291431 A1 * 10/2014 Huang ..... E06B 9/322 242/372
2015/0136336 A1 * 5/2015 Huang ..... E06B 9/322 160/170
2015/0176329 A1 * 6/2015 Chen ..... E06B 9/322 160/176.1 R
2015/0176331 A1 * 6/2015 Chen ..... E06B 9/42 160/243
2015/0275572 A1 * 10/2015 Huang ..... E06B 9/322 160/173 R
2015/0275573 A1 * 10/2015 Huang ..... E06B 9/322 160/192

* cited by examiner

BLIND BODY POSITIONING MECHANISM FOR NON PULL CORD WINDOW BLIND AND WINDOW BLIND USING THE SAME

BACKGROUND OF THE INVENTION

1. Field of the Invention

The present invention relates to window blind technology, and more particularly to a blind body positioning mechanism for non pull cord window blind and a non pull cord window using the blind body positioning mechanism.

2. Description of the Related Art

Commercial window blinds can be classified into pull-cord window blinds and non pull cord window blinds. A pull-cord window blind uses a pull cord for pulling by a user to move the blind between an extended status and a received status. A non pull cord window blind allows a user to pull down or lift the bottom rail, causing the blind to be moved between an extended status and a received status.

Although a non pull cord blind allows users to easily extend out or receive the blind body, the blind body is prone to rebounding after fully extended out, or sagging after fully received, due to lack of good positioning design in the structural configuration, bringing trouble to the user in actual operation.

SUMMARY OF THE INVENTION

The present invention has been accomplished under the circumstances in view. It is the main object of the present invention to provide a blind body positioning mechanism for non pull cord window blind, which has a simple structure and provides excellent positioning effects, enhancing operating convenience.

To achieve this and other objects of the present invention, a blind body positioning mechanism comprises a transmission unit and a damper unit. The transmission unit comprises a casing, two first transmission wheels, a coil spring, two second transmission wheels, and at least two transmission cords. The two first transmission wheels are rotatably mounted in the casing and meshed with each other. The coil spring is connected between the two first transmission wheels and selectively wound round one first transmission wheel. The two second transmission wheels are rotatably mounted in the casing and respectively meshed with one respective first transmission wheel. Each transmission cord has one end thereof fixedly connected to one respective second transmission wheel, and is wound round the respective second transmission wheel during rotation of the respective second transmission wheel. The damper unit comprises a damping reel holder, a damper, and a damping reel. The damper comprises an oil reservoir and a brake gear. The oil reservoir is fixedly mounted in the damping reel holder. The brake gear is pivotally mounted on the oil reservoir. The damping reel is wound with one transmission cord. The damping reel has one end thereof pivotally connected to the damping reel holder, and an opposite end thereof provided with a toothed coupling hole for engagement with the brake gear of the damper.

Thus, when the transmission cords are stretched by an external force, they will synchronously drive the damping reel to rotate. During rotation of the damping reel, the brake gear of the damper imparts a damping resistance to the damping reel through the damping oil in the oil reservoir. This damping resistance will become in static balance with the elastic restoring force of the coil spring as the external force disappears, providing the blind body with a good positioning effect.

Preferably, each first transmission wheel comprises a first transmission sprocket, and a first transmission wheel shaft fixedly connected with the first transmission sprocket. The coil spring is connected between the first transmission wheel shafts of the two first transmission wheels, and selectively wound round the first transmission wheel shaft of one first transmission wheel. Each second transmission wheel comprises a second transmission sprocket, and a second transmission wheel shaft fixedly connected with the second transmission sprocket. The second transmission sprocket is meshed with the first transmission sprocket of one respective first transmission wheel. Each transmission cord has one end thereof fixedly connected to the second transmission wheel shaft of one respective second transmission wheel.

Preferably, the damping reel holder comprises two opposing upright side panels, a pivot hole located on one upright side panel, and a mounting slot located on the other upright side panel. The damping reel has one end thereof pivotally coupled to the pivot hole of the damping reel holder. The oil reservoir is fixedly mounted in the mounting slot of the damping reel holder. The brake gear is disposed outside the mounting slot.

A non pull cord window blind using the aforesaid blind body positioning mechanism in accordance with the present invention comprises a top rail, a bottom rail spaced below the top rail, and a blind body coupled between the top rail and the bottom rail. The casing of the blind body positioning mechanism is mounted in the bottom rail. The damping reel holder of the damper unit of the blind body positioning mechanism is mounted in the bottom rail. Each transmission cord of the blind body positioning mechanism has an opposite end thereof inserted through the blind body and connected to the top rail. Thus, the transmission cords can be stretched when the bottom rail is pulled down.

Other advantages and features of the present invention will be fully understood by reference to the following specification in conjunction with the accompanying drawings, in which like reference signs denote like components of structure.

DETAILED DESCRIPTION OF THE INVENTION

Figure 1:
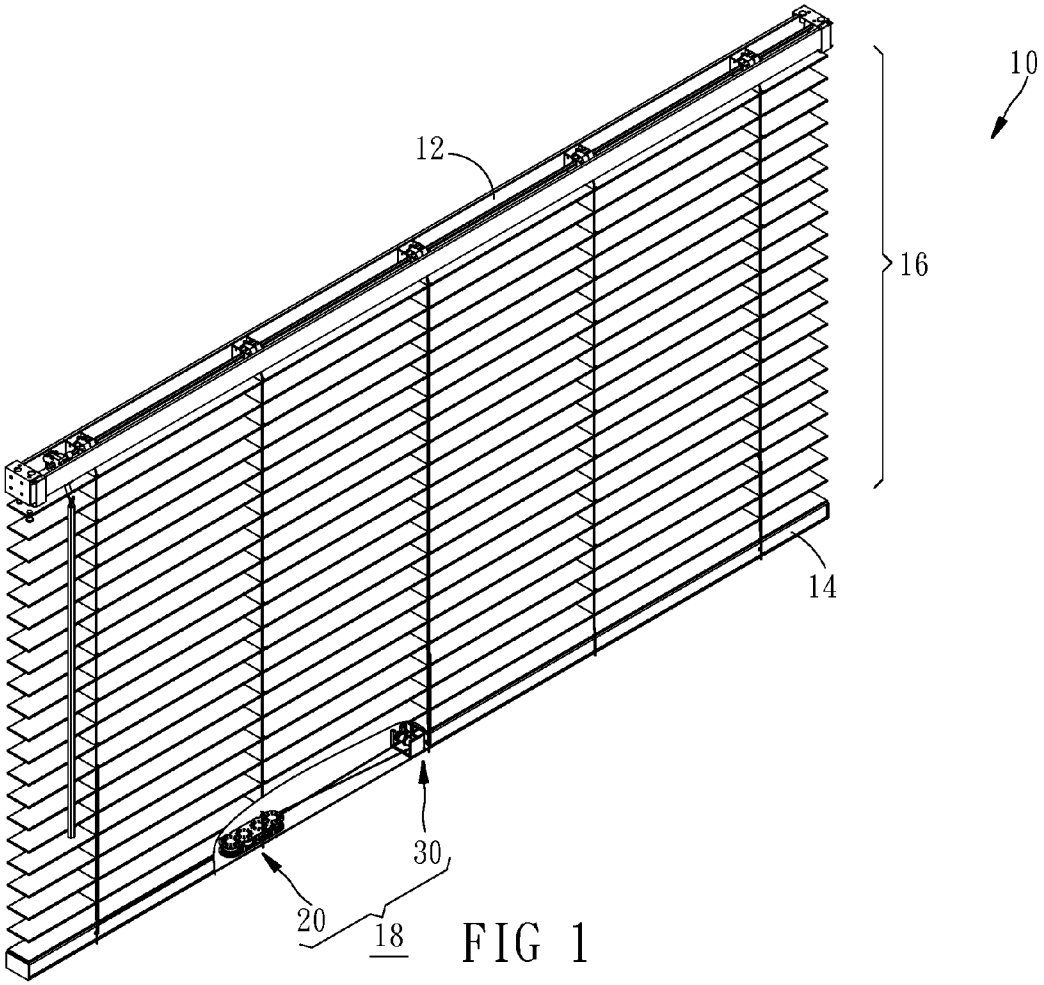
FIG. 1 is an oblique top elevational view of a non pull cord window blind in accordance with the present invention.
Figure 2:
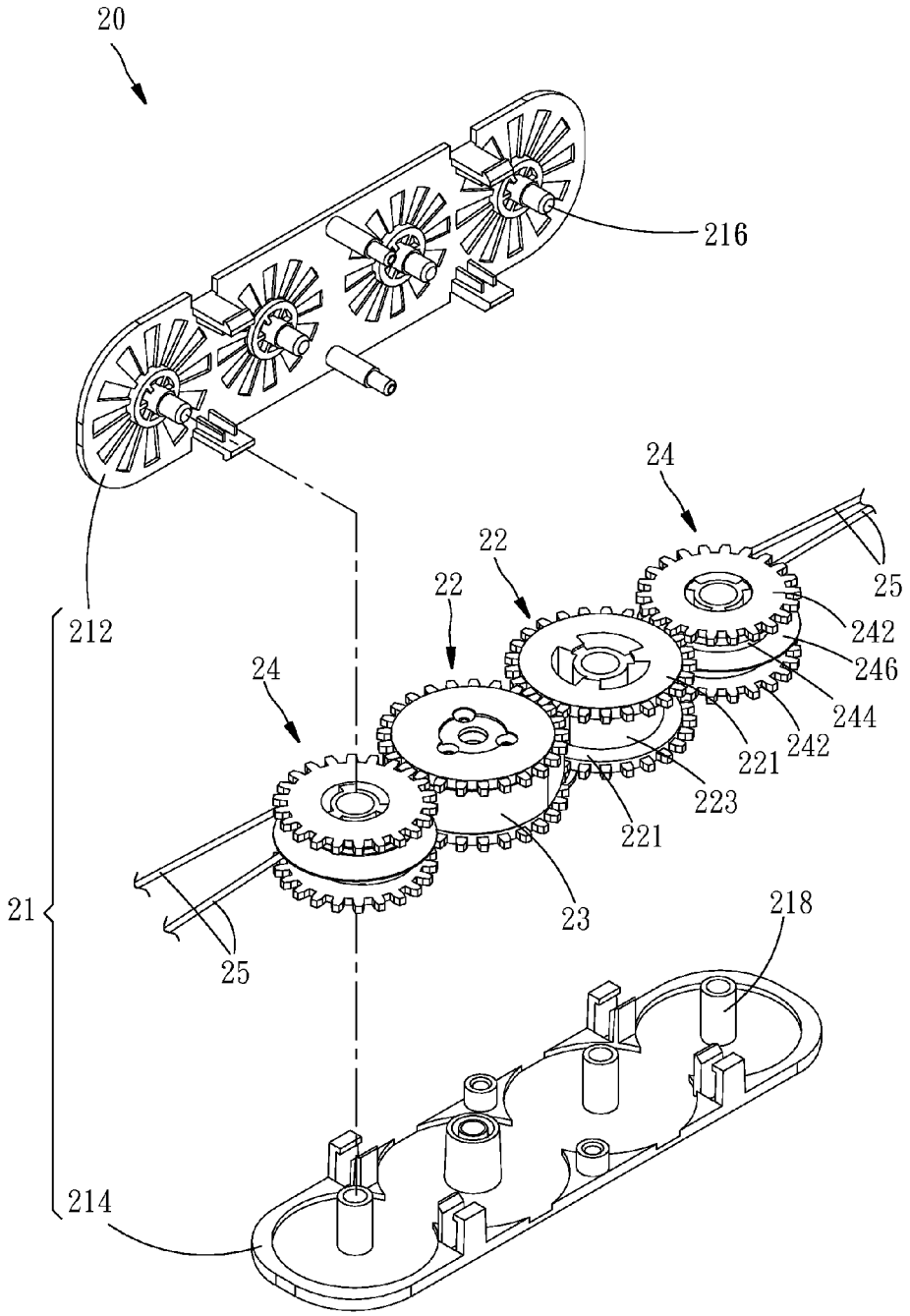
FIG. 2 is an exploded view of the transmission unit of the non pull cord window blind in accordance with the present invention.
Figure 3:
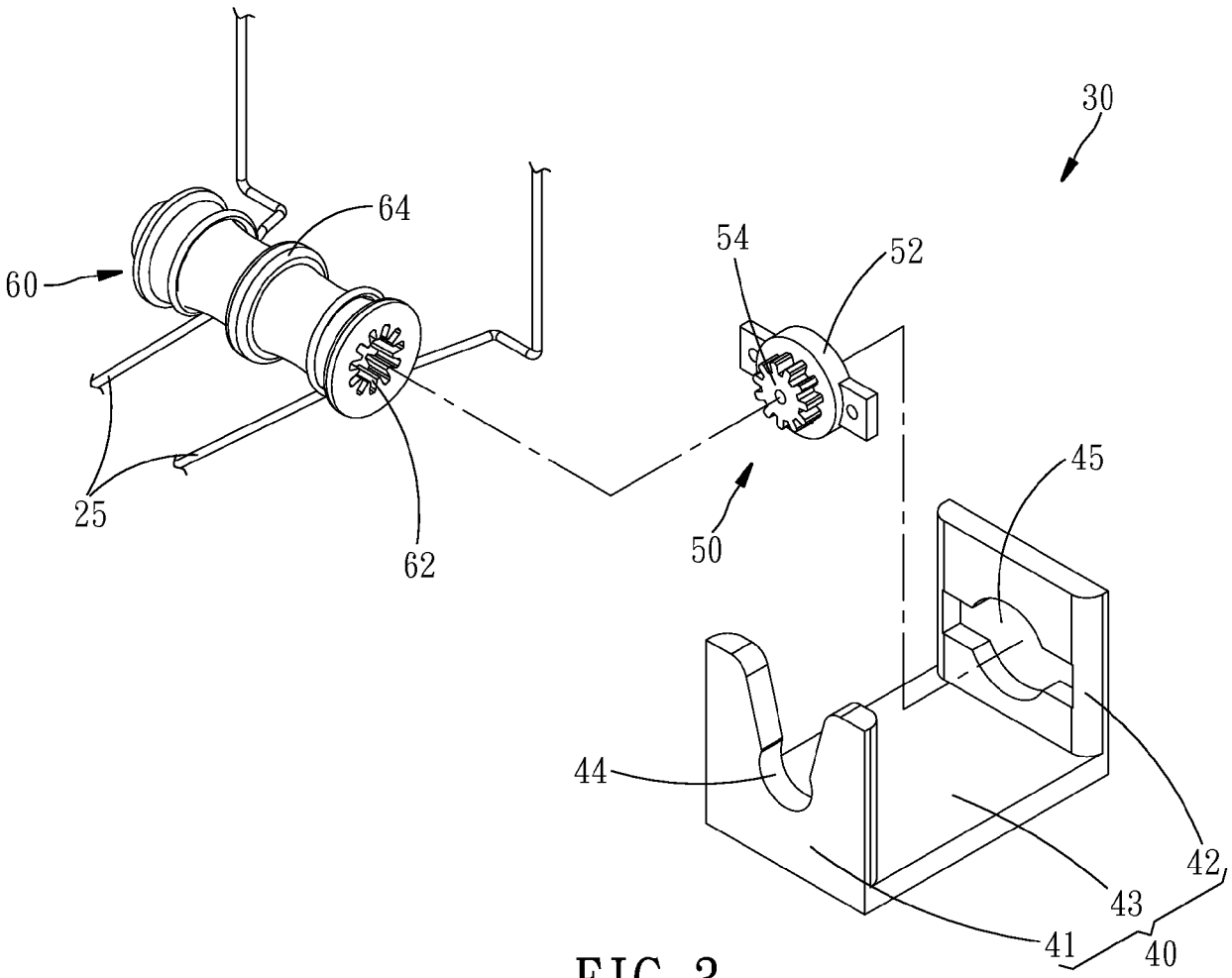
FIG. 3 is an exploded view of the damper unit of the non pull cord window blind in accordance with the present invention.
Figure 4:
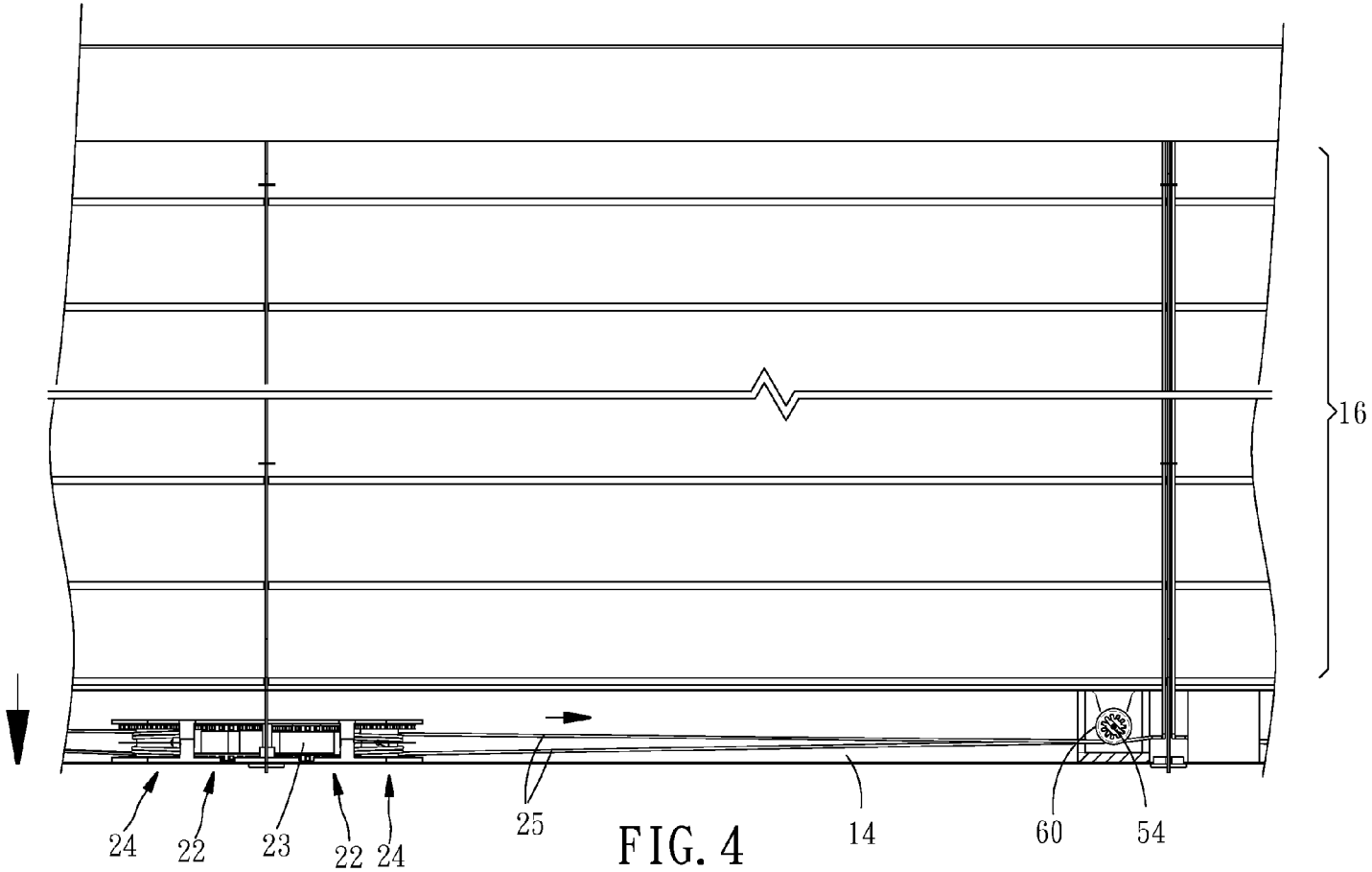
FIG. 4 is a schematic plain view of the present invention, illustrating a status of the non pull cord window blind after the transmission cords of the blind body positioning mechanism having been stretched.

Referring to FIG. 1, a non pull cord window blind 10 in accordance with the present invention is shown. As illustrated, the non pull cord window blind 10 comprises a top rail 12, an opposing bottom rail 14, and blind body 16 coupled between the top rail 12 and the bottom rail 14. Referring also to FIG. 2 and FIG. 3, a blind body positioning mechanism 18 in accordance with the present invention is shown used in the aforesaid non pull cord window blind 10, comprising a transmission unit 20 and a damper unit 30.

The transmission unit 20 comprises a casing 21, two first transmission wheels 22, a coil spring 23, two second transmission wheels 24, and two pairs of transmission cords 25.

Each first transmission wheel 22 comprises two first transmission sprockets 221 (actually, one single transmission sprocket can achieve the same effect), and a first transmission wheel shaft 223 connected between the two first transmission sprockets 221. During installation, the first transmission wheel shaft 223 is rotatably coupled between a respective top pivot pin 216 at a top locating plate 212 of the casing 21 and a respective bottom pivot pin 218 at a bottom locating plate 214 of the casing 21. After installation, the first transmission sprockets 221 of the first transmission wheels 22 are meshed together.

The coil spring 23 connects the first transmission wheel shafts 223 of the two first transmission wheels 22, and is wound round the first transmission wheel shaft 223 of one first transmission wheel 22 during relative rotation between the two first transmission wheels 22.

Each second transmission wheel 24 comprises two second transmission sprockets 242, and a second transmission wheel shaft 244 connected between the two second transmission sprockets 242. During installation, the second transmission wheel shaft 244 is rotatably coupled between a respective top pivot pin 216 at the top locating plate 212 of the casing 21 and a respective bottom pivot pin 218 at the bottom locating plate 214 of the casing 21. After installation, the second transmission sprockets 242 of the second transmission wheels 24 are respectively meshed with the first transmission sprockets 221 of the first transmission wheels 22. Thus, the first transmission wheels 22 and the second transmission wheels 24 can be rotated synchronously.

Each pair of transmission cords 25 have respective one ends thereof fixedly connected to the second transmission wheel shafts 244 of one respective second transmission wheel 24, and respective opposite ends thereof inserted through the blind body 16 and fixedly connected to the top rail 12. To prevent the two transmission cords 25 from being tangled with each other during rotation of the second transmission wheel 24, the second transmission wheel shaft 244 of each second transmission wheel 24 is configured to provide an annular isolating rib 246 that extends around the second transmission wheel shaft 244 on the middle to keep the two transmission cords 25 apart.

Referring to FIG. 3 again, the damper unit 30 comprises a damping reel holder 40, a damper 50, and a damping reel 60.

The damping reel holder 40 is fixedly mounted in the bottom rail 14, comprising two opposing upright side panels 41 and 42, a horizontal bottom panel 43 connected between the two upright side panels 41 and 42, a pivot hole 44 located in one upright side panel 41, and a mounting slot 45 located in the other upright side panel 42.

The damper 50 comprises an oil reservoir 52 and a brake gear 54. The oil reservoir 52 is fixedly mounted in the mounting slot 45 of the damping reel holder 40 for storing a high viscosity damping oil. The brake gear 54 is pivotally mounted on the oil reservoir 52 and disposed outside the mounting slot 45 of the damping reel holder 40.

The damping reel 60 has one end thereof pivotally mounted in the pivot hole 44 of the damping reel holder 40, and an opposite end thereof provided with a toothed coupling hole 62. The toothed coupling hole 62 of the damping reel 60 can be engaged with the brake gear 54 of the damper 50, enabling the damping reel 60 to be synchronously rotated with the brake gear 54. Further, the damping reel 60 is wound round by one pair of transmission cords 25.

To prevent these two transmission cords 25 from being tangled with each other during rotation of the damping reel 60, the damping reel 60 is configured to provide an isolating flange 64 that extends around the periphery of the damping reel 60 on the middle to keep the two transmission cords 25 apart.

From the structure stated above, it can be known that when wishing to extend out the blind body 16, pull the bottom rail 14 downwards to stretch the transmission cords 25. When the transmission cords 25 are being stretched, on the one hand, the second transmission wheels 24 are rotated by the transmission cords 25, causing the first transmission wheels 22 to be respectively rotated by the second transmission wheels 24. At this time, the coil spring 23 is rolled up from one first transmission wheel 22 onto the other transmission wheel 22 to accumulate an elastic restoring force. On the other hand, the damping reel 60 is driven by the transmission cords 25 to rotate the brake gear 54 to the extent where the blind body 16 is fully extended out and the user releases the pulling force from the bottom rail 14. At this time, the damping oil in the oil reservoir 52 imparts a damping resistance to the damping reel 60 that will be in static balance with the elastic restoring force of the coil spring 23 to prohibit the transmission cords 25 from being rolled up by the respective second transmission wheels 24, and thus, the blind body 16 is accurately held in the extended position, as shown in FIG. 1.

Figure 5:
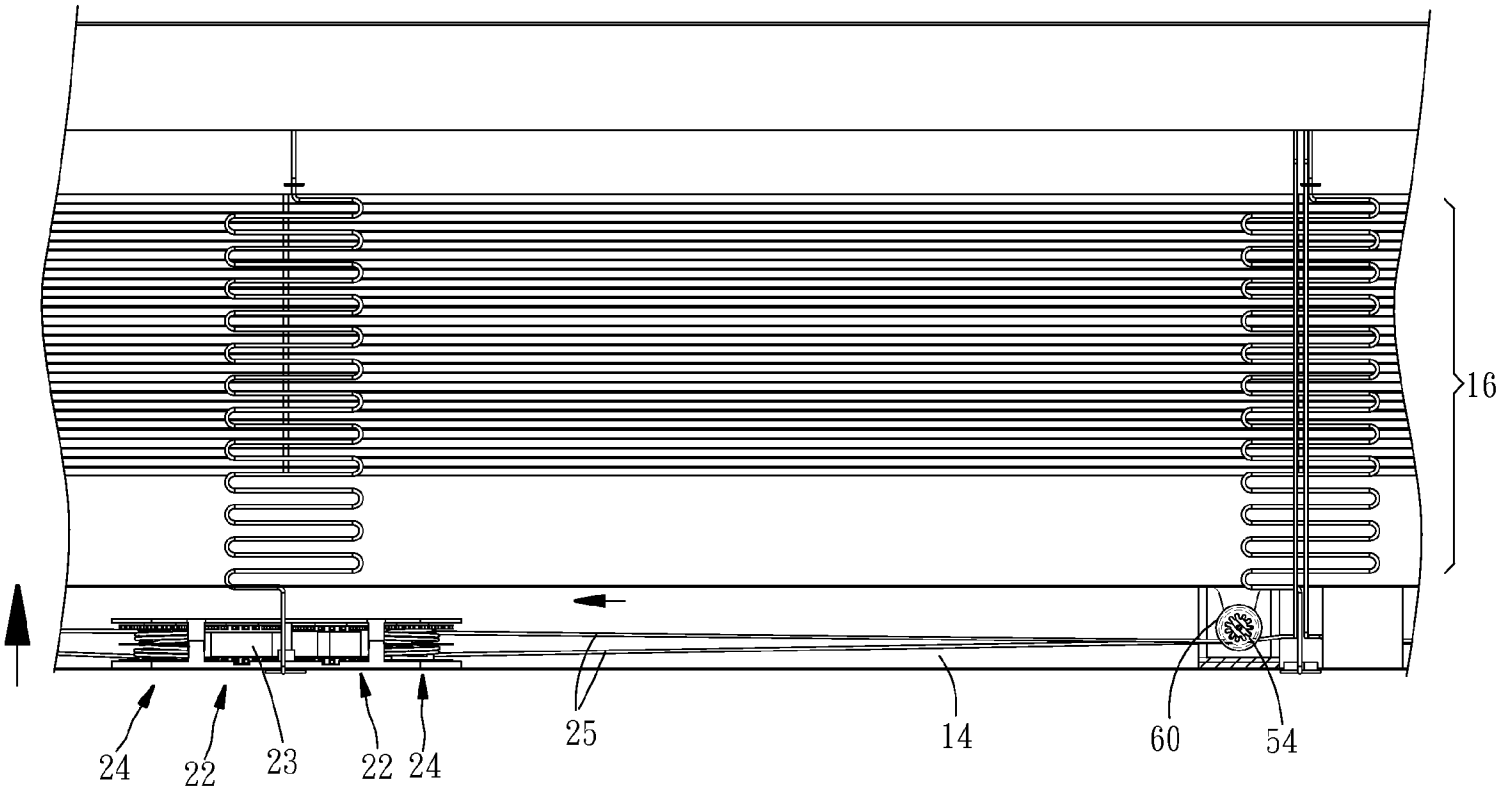
FIG. 5 is similar to FIG. 4, illustrating a status of the non pull cord window blind after the transmission cords of the blind body positioning mechanism having been rolled up.
Figure 6:
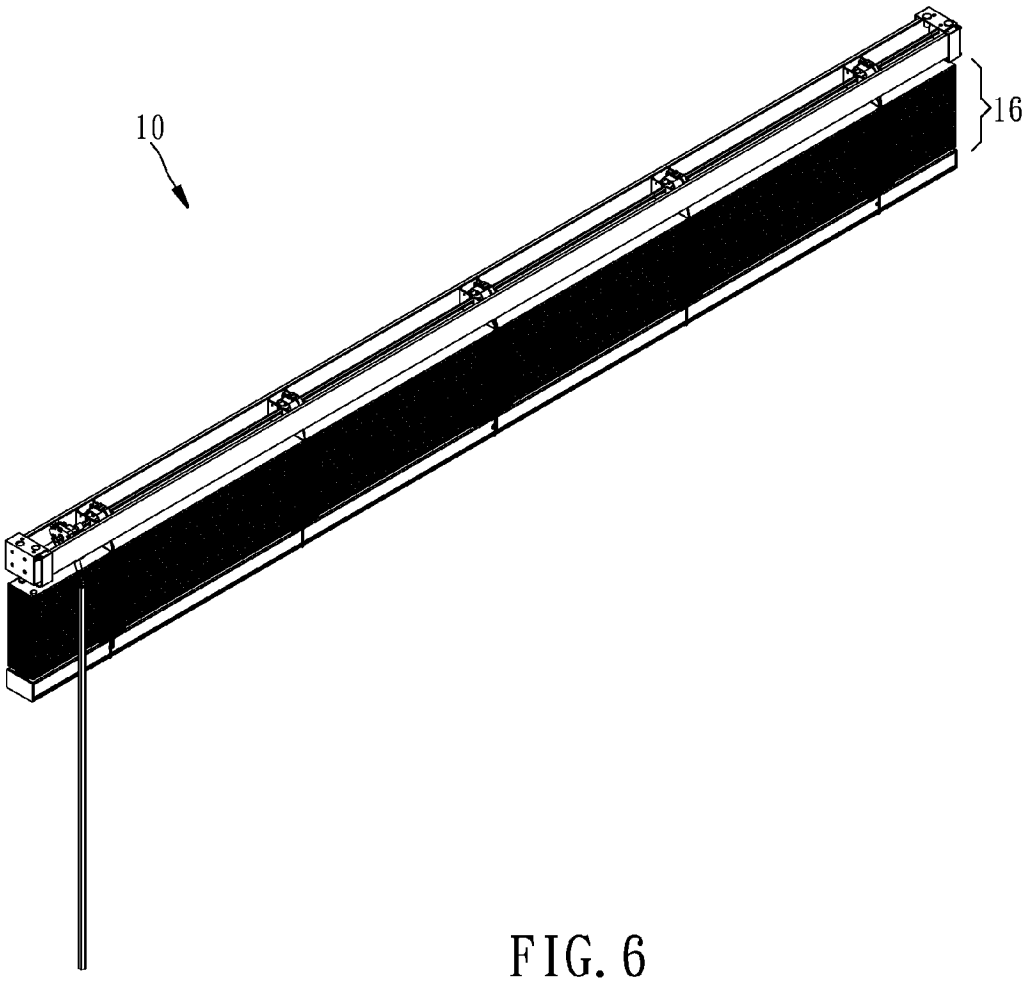
FIG. 6 is similar to FIG. 1, illustrating the blind body in the received status.

When wishing to receive the blind body 16, push the bottom rail 14 upwards. At this time, as shown in FIG. 5, the elastic restoring force of the coil spring 23 assists the user's push force to overcome the damping resistance being given by the damping oil in the oil reservoir 52 to the damping reel 60 through the brake gear 54. At this time, the first transmission wheels 22 are reversed, thereby rotating the second transmission wheels 24 to roll up the respective transmission cords 25 and to further lift the blind body 16. The user can then releases the push force from the bottom rail 14 after the blind body 16 is fully received. At this time, the elastic restoring force of the coil spring 23 becomes in static balance with the damping resistance of the damping oil, and thus, the blind body 16 is accurately held in the received position, as shown in FIG. 6.

In conclusion, the blind body positioning mechanism 18 of the invention utilizes the damping resistance of the damper 50 to provide the blind body 16 with a good positioning effect, eliminating the problem of rebounding after fully extended out or sagging after fully received, and enhancing operating convenience.

What is claimed is:

1. A blind body positioning mechanism used in a non pull cord window blind, comprising:

a transmission unit comprising a casing, two first transmission wheels, a coil spring, two second transmission wheels and at least two transmission cords; said two first transmission wheels being rotatably mounted in said casing and meshed with each other, said coil spring being connected between said two first transmission wheels and selectively wound round one said first transmission wheel, said two second transmission wheels being rotatably mounted in said casing and respectively meshed with said first transmission wheels, and said transmission cords respectively fixedly connected to said second transmission; said transmission cords wound round said respective second transmission wheels due to rotation of the respective said second transmission wheel; and a damper unit comprising a damping reel holder, a damper and a damping reel, said damper comprising an oil reservoir and a brake gear; said oil reservoir being fixedly mounted in said damping reel holder, said brake gear being pivotally mounted on said oil reservoir, said damping reel being wound with at least one said transmission cord, which is from one said second transmission wheel, said damping reel having one end thereof pivotally connected to said damping reel holder and an opposite end thereof provided with a toothed coupling hole; said toothed coupling hole being engaged with said brake gear of said damper;

wherein the damper provides a damping resistance that is in static balance with an elastic restoring force of the coil spring.

2. The blind body positioning mechanism as claimed in claim 1, wherein said damping reel holder comprises two opposing upright side panels, a pivot hole located on one said upright side panel, and a mounting slot located on the other said upright side panel; said damping reel has one end thereof pivotally coupled to said pivot hole of said damping reel holder; said oil reservoir is fixedly mounted in said mounting slot of said damping reel holder; said brake gear is disposed outside said mounting slot.

3. The blind body positioning mechanism as claimed in claim 1, wherein each said first transmission wheel comprises a first transmission sprocket and a first transmission wheel shaft fixedly connected with said first transmission sprocket; said coil spring being connected between the first transmission wheel shafts of said two first transmission wheels and selectively wound round the first transmission wheel shaft of one said first transmission wheel; each said second transmission wheel comprises a second transmission sprocket and a second transmission wheel shaft fixedly connected with said second transmission sprocket; said second transmission sprocket meshes with the first transmission sprocket, while said second transmission wheel is adjacent to said first transmission wheel; said transmission cords have one end thereof fixedly connected to the second transmission wheel shaft of said second transmission wheels respectively.

4. The blind body positioning mechanism as claimed in claim 3, wherein said casing comprises a top locating plate and a bottom locating plate, said top locating plate comprising four top pivot pins respectively downwardly inserted into the first transmission wheel shafts of said first transmission wheels and the second transmission wheel shafts of said second transmission wheels, said bottom locating plate comprising four bottom pivot pins respectively upwardly inserted into the first transmission wheel shafts of said first transmission wheels and the second transmission wheel shafts of said second transmission wheels.

5. The blind body positioning mechanism as claimed in claim 3, wherein the number of said transmission cords is 4, and these four transmission cords are arranged in two pairs, and two pairs respectively connected to the second transmission wheel shafts of said second transmission wheels; each said second transmission wheel shaft comprises an annular isolating rib extending around the periphery thereof on the middle to keep two said transmission cords of each pair apart; a selective one of said two pairs wind round said damping reel; said damping reel comprises an isolating flange extending around the periphery thereof for separating two said transmission cords of the selective one pair.

6. The blind body positioning mechanism as claimed in claim 5, wherein said casing comprises a top locating plate and a bottom locating plate, said top locating plate comprising four top pivot pins respectively downwardly inserted into the first transmission wheel shafts of said first transmission wheels and the second transmission wheel shafts of said second transmission wheels, said bottom locating plate comprising four bottom pivot pins respectively upwardly inserted into the first transmission wheel shafts of said first transmission wheels and the second transmission wheel shafts of said second transmission wheels.

7. A non pull cord window blind, comprising:

a top rail;

a bottom rail spaced below said top rail;

a blind body coupled between said top rail and said bottom rail; and a blind body positioning mechanism as claimed in claim 1, said casing of said blind body positioning mechanism being mounted in said bottom rail, each said transmission cord of said blind body positioning mechanism having an opposite end thereof inserted through said blind body and connected to said top rail, said damping reel holder being mounted in said bottom rail.

8. The blind body positioning mechanism as claimed in claim 7, wherein said damping reel holder comprises two opposing upright side panels, a pivot hole located on one said upright side panel, and a mounting slot located on the other said upright side panel; said damping reel has one end thereof pivotally coupled to said pivot hole of said damping reel holder; said oil reservoir is fixedly mounted in said mounting slot of said damping reel holder; said brake gear is disposed outside said mounting slot.

9. The non pull cord window blind as claimed in claim 7, wherein each said first transmission wheel comprises a first transmission sprocket and a first transmission wheel shaft fixedly connected with said first transmission sprocket; said coil spring being connected between the first transmission wheel shafts of said two first transmission wheels and selectively wound round the first transmission wheel shaft of one said first transmission wheel; each said second transmission wheel comprises a second transmission sprocket and a second transmission wheel shaft fixedly connected with said second transmission sprocket; said second transmission sprocket meshes with the first transmission sprocket, while said second transmission wheel is adjacent to said first transmission wheel; said transmission cords have one end thereof fixedly connected to the second transmission wheel shaft of said second transmission wheels respectively.

10. The non pull cord window blind as claimed in claim 9, wherein said casing comprises a top locating plate and a bottom locating plate, said top locating plate comprising four top pivot pins respectively downwardly inserted into the first transmission wheel shafts of said first transmission wheels and the second transmission wheel shafts of said second transmission wheels, said bottom locating plate comprising four bottom pivot pins respectively upwardly inserted into the first transmission wheel shafts of said first transmission wheels and the second transmission wheel shafts of said second transmission wheels.

11. The non pull cord window blind as claimed in claim 9, wherein the number of said transmission cords is 4, and these four transmission cords are arranged in two pairs, and two pairs respectively connected to the second transmission wheel shafts of said second transmission wheels; each said second transmission wheel shaft comprises an annular isolating rib extending around the periphery thereof on the middle to keep two said transmission cords of each pair apart; a selective one of said two pairs wind round said damping reel; said damping reel comprises an isolating flange extending around the periphery thereof for separating two said transmission cords of the selective one pair.

12. The non pull cord window blind as claimed in claim 11, wherein said casing comprises a top locating plate and a bottom locating plate, said top locating plate comprising four top pivot pins respectively downwardly inserted into the first transmission wheel shafts of said first transmission wheels and the second transmission wheel shafts of said second transmission wheels, said bottom locating plate comprising four bottom pivot pins respectively upwardly inserted into the first transmission wheel shafts of said first transmission wheels and the second transmission wheel shafts of said second transmission wheels.

* * * * *